United States Patent [19]

Satoh

[11] 4,281,682

[45] Aug. 4, 1981

[54] PROPORTIONAL CONTROL TYPE REMOTE-CONTROL DIRECTION SWITCHING CONTROL VALVE DEVICE

[75] Inventor: Yuji Satoh, Higashimatsuyama, Japan

[73] Assignee: Diesel Kiki Co., Ltd., Tokyo, Japan

[21] Appl. No.: 164,309

[22] Filed: Jun. 30, 1980

Related U.S. Application Data

[62] Division of Ser. No. 57,410, Jul. 13, 1979.

[30] Foreign Application Priority Data

Jul. 18, 1978 [JP] Japan ..... 53-86790
Jul. 18, 1978 [JP] Japan ..... 53-86791

[51] Int. Cl.[3] ..... F15B 13/044

[52] U.S. Cl. ..... 137/596.17; 137/596.1; 137/870

[58] Field of Search ..... 137/116.3, 596.1, 596.17, 137/870

[56] References Cited

U.S. PATENT DOCUMENTS 3,995,652 12/1976 Belart et al. ..... 137/116.3 X

FOREIGN PATENT DOCUMENTS 194321 2/1965 Sweden ..... 137/596.17

*Primary Examiner*—Gerald A. Michalsky
*Attorney, Agent, or Firm*—John E. Toupal

[57] ABSTRACT

A remotely operated, direction switching proportional control device comprises a direction switching control valve which includes a hydraulic actuator, an electromagnetic pressure reducing valve interposed between a liquid chamber of the hydraulic actuator and a hydraulic power source and an electromagnetic open or closed valve interposed between the liquid chamber and a liquid tank. Both the pressure-reducing valve and the open or closed valve can be operated against an electromagnetic force for return movement. The device eliminates the requirement for a piston stroke detector and may be operated by a single electromagnetic coil.

1 Claim, 4 Drawing Figures

PRIOR ART

PROPORTIONAL CONTROL TYPE REMOTE-CONTROL DIRECTION SWITCHING CONTROL VALVE DEVICE

CROSS-REFERENCE TO RELATED APPLICATION

This invention is a division of U.S. application Ser. No. 57,410, filed July 13, 1979, entitled "Proportional Control Type Remote-Control Direction Switching Control Valve Device".

BACKGROUND OF THE INVENTION

1. Field of the Invention

The present invention relates to proportional control type remote-control direction switching control valve devices in which the operational mode of a direction switching control valve is established by a hydraulic feedback circuit, and an opening of a valve passage is adjusted to control the speed of a main hydraulic actuator.

2. Description of the Prior Art

Most cranes employ a hydraulic actuator to extend or contract a boom. Generally, the hydraulic actuator includes a direction switching control valve connected between the actuator and a hydraulic power supply unit and operable to control both the direction and speed of boom movement.

Such a direction switching control valve may be operated directly by a handle. However, in order to remotely operate the valve, a sub-hydraulic actuator can be connected to the direction switching control valve and used to control the hydraulic circuit.

In the past, remotely-controlled direction switching control valve devices of the type as shown in FIG. 1 have been proposed. As illustrated, a 6-port 3-position direction switching control valve 2 has a spool which is switched between valve positions a, b and c to vary the opening of valve passages. The spool is normally held at the neutral position by means of return springs 3 and 4 and can be operated either directly by a hand lever 1 or driven by a sub-hydraulic actuator 8 connected by a rod 6. A cylinder 7 has liquid chambers 10 and 11 defined by a piston 9, the liquid chamber 10 being connected between solenoid valves 15 and 16 and the liquid chamber 11 being connected between solenoid valves 16 and 17.

The solenoid valves 15, 16 and 17 are connected in series between a hydraulic power source P and a tank R. Normally in a position e which closes a circuit, the solenoid valve 15 is switched to a position d against a spring 18*a* when an electromagnetic coil 18 is excited. The solenoid valves 16 and 17 are normally in positions g and k, respectively, and when electromagnetic coils 19 and 20 are excited, the valves 16 and 17 are switched to closed positions f or h, respectively.

A control circuit 13 compares an electric signal from a detector 14, such as a differential transformer or a potentiometer which detects the displacement of the piston 9, and an electric signal from a circuit 12 being a differential transformer or a potentiometer actuated by an operator. The electric control circuit 13 generates an output signal that energizes the electromagnetic coils 18, 19 and 20 to control the hydraulic actuator 8. When the position of the piston 9, as measured by the detector 14 is in coincidence with the predetermined target value of the operating circuit 12, the output signal from the control circuit 13 is terminated to stop the operation of the hydraulic actuator 8. For example, when rightward movement of hydraulic actuator 8 is desired, the solenoid valves 15 and 16 are energized; when leftward movement is desired, the solenoid valves 15 and 17 are energized; and when stoppage of the hydraulic actuator 8 is desired, the solenoid valves 16 and 17 are energized.

One disadvantage of the prior art direction switching control valve device described above exists when each of the electromagnetic coils 18, 19 amd 20 is de-energized. Under those conditions, variations in the pressure of the tank R can produce undesirable movement of the piston 9. When the pressure of the tank R increases, the piston 9 moves leftward because the pressure-receiving area on the left side of the piston 9 is less than the pressure-receiving area on the right side thereof. Another disadvantage is that an element similar to the rod 6 cannot be utilized on the right side of the piston 9.

SUMMARY OF THE INVENTION

It is, therefore, an object of the present invention to provide an inexpensive remotely controlled proportional type direction switching control valve device that eliminates problems associated with prior art devices and that does not require a piston displacement detector.

It is a further object of the present invention to provide such a device that can be operated by a single energizing means; i.e., an electromagnetic coil to obtain an output liquid pressure proportional to the level of voltage or current that excites the electromagnetic coil.

Other objects and features of the invention will be pointed out in the following description and claims and illustrated in the accompanying drawings.

BRIEF DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 2:
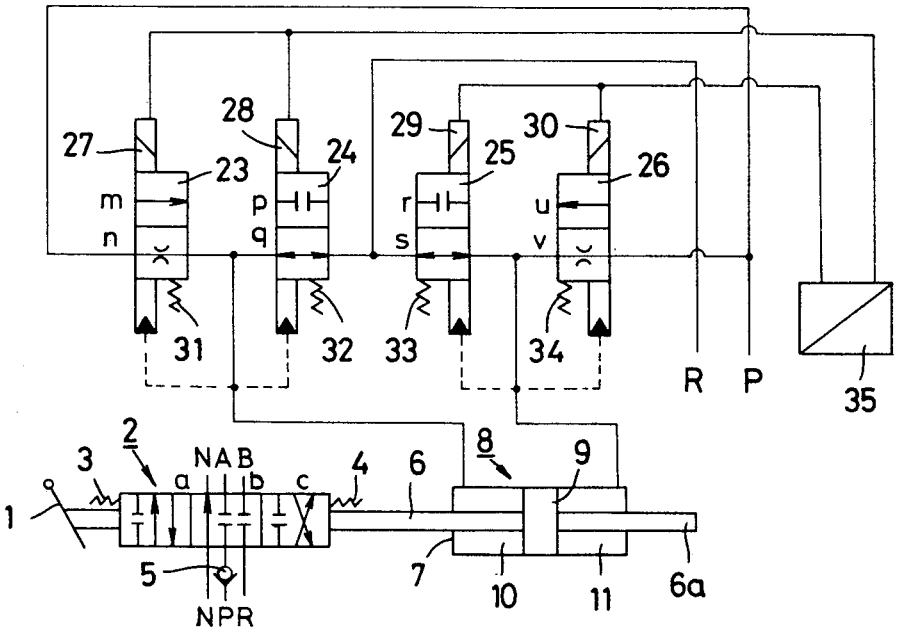
FIG. 2 is a circuit diagram of a direction switching control valve device in accordance with the present invention.

Referring to FIG. 2, the control valve device of the present invention has a pair of solenoid valves connected to each liquid chamber 10 and 11, respectively, of a hydraulic actuator 8 connected to a direction switching control valve 2 by a rod 6. As shown, an electromagnetic pressure-reducing valve 23 is connected between the liquid chamber 10 and a hydraulic power source P, and an open or closed electromagnetic valve 24 is connected between the liquid chamber 10 and a reservoir tank R. Similarly, an electromagnetic pressure-reducing valve 26 is connected between the liquid chamber 11 and the hydraulic power source P, and an open or closed electromagnetic valve 25 is connected between the liquid chamber 11 and the tank R. The pressure-reducing valve 23 is normally in a throttle position n, and when an electromagnetic coil 27 is energized, a spool is switched to a full open position m against a spring 31. The liquid in the chamber 10 exerts a pressure on the spool that is opposed to the electromagnetic force of the electromagnetic coil 27. The open or closed valve 24 is normally in a full-open position q and is switched to a closed position p against the spring 32 when the electromagnetic coil 28 is energized. Again the liquid in the chamber 10 exerts a pressure on the spool in opposition to the electromagnetic force produced by the coil 28. The pressure-reducing valve 26 and open or closed valve 25 have a construction similar to that of the aforementioned electromagnetic pressure-reducing valve 23 and electromagnetic open or closed valve 24.

Figure 1:
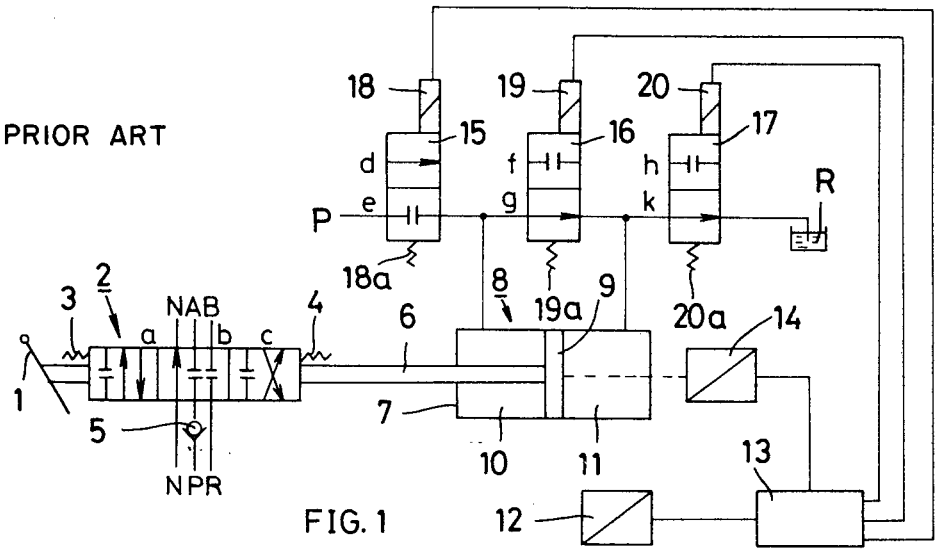
FIG. 1 is a circuit diagram of a conventional remotely controlled direction switching control valve device.

It will be noted that the direction switching control valve 2 and the hydraulic actuator 8 of FIG. 2 are similar to those shown in FIG. 1 and corresponding parts thereof bear the same reference numerals. However, in the hydraulic actuator 8 of FIG. 2 a rod 6a is provided additionally on the right-hand side of the piston 9.

Next, the operation of the remote-control direction switching control valve device in accordance with the present invention will be described. When the piston 9 of the hydraulic actuator 8 is to be moved leftward as shown in FIG. 2, a signal is fed to the electromagnetic valves 25 and 26 by a differential transformer or a potentiometer in a remote-control circuit 35 to energize the electromagnetic coils 29 and 30. After energization, the electromagnetic valve 25 is switched to its closed position r and the electromagnetic throttle valve 26 is switched to its full open position u. Accordingly, pressurized liquid from the hydraulic power source P flows into the liquid chamber 11 through the valve 26 to move the piston 9 leftward. The liquid in the chamber 10 is returned to the tank R via the open electromagnetic valve 24. It should be noted that the electromagnetic pressure-reducing valve 23 remains in the throttle position n to establish a reduced liquid pressure in the chamber 10. Thus, the amount of liquid returned to the tank R via the open valve 24 is small.

As the piston 9 moves leftward, the direction switching control valve 2 is switched from a neutral position which movement gradually opens a valve passage and consequently increases the working speed of a main hydraulic actuator (not shown) operated by the direction switching control valve 2. The degree to which the valve passage of the direction switching control valve 2 opens is controlled by the position of the piston 9 of the sub-hydraulic actuator 8, and the operating position of the piston 9 is controlled by current or voltage applied to the electromagnetic coils 29 and 30. That is, when the piston 9 and the spool of the direction switching control valve 2 are moved leftward against the spring 3, pressure in the liquid chamber 11 increases in response to the force thereon. This pressure in the liquid chamber 11 exerts forces on the respective spools of the electromagnetic pressure-reducing valve 26 to effect movement thereof to positions balanced with the electromagnetic force exerted by the coils 29, 30.

Let $f_1$ represent the electromagnetic force of the electromagnetic coil 29, $f_2$ the electromagnetic force of the electromagnetic coil 30 and $f_m$ the force produced by the pressure in the liquid chamber 11, and when the reaction of the spring 3 of the direction switching control valve 2 produces the relationship $f_1 \geqq f_m \geqq f_2$, the electromagnetic pressure-reducing valve 26 moves toward the position v and leftward movement of the piston 9 slows down. However, even if the electromagnetic pressure-reducing valve 26 assumes the position v, pressurized liquid, though small in amount, flows continuously from the hydraulic power source P to the liquid chamber 11 and pressure therein is gradually increased in response to leftward movement of the piston 9. Finally, when $f_1 \leqq f_m \geqq f_2$, the electromagnetic open or closed valve 25 is switched to an open position, and the pressure in the liquid chamber 11 is released into the tank R via the open electromagnetic valve 25. When the pressure in the liquid chamber 11 is thus lowered, the electromagnetic valve 25 is again switched to its closed position r, and the electromagnetic pressure-reducing valve 26 assumes its full open position u.

During conditions in which the electromagnetic coils 29 and 30 are energized, the operation of the electromagnetic pressure-reducing valve 26 and the electromagnetic open or closed valve 25 as described above is repeatedly accomplished, the average pressure versus time in the liquid chamber 11 is determined by the energization forces of the electromagnetic coils 29 and 30, and the strokes of the piston 9 and the spool of the direction switching control valve 2 connected thereto are maintained in positions wherein the liquid pressure in the liquid chamber 11 and the force of the spring 3 are balanced. Thus the rate at which liquid flows into one of the liquid chambers A and B of the main hydraulic actuator from the hydraulic power source P via the direction switching control valve 2 is responsive to the opening degree of the valve 2 which thereby controls the working speed of the main hydraulic actuator. That is, the piston 9 may be held in a preselected position by adjusting the energizing force on the electromagnetic coils 29 and 30 and thereby establish a desired opening degree of the valve passage of the direction switching control valve 2. That opening will in time produce with the main hydraulic actuator a desired working speed.

When the piston 9 of the hydraulic actuator 8 is returned and the direction switching control valve 2 assumes the neutral position b, the electromagnetic coils 29 and 30 are de-energized and the valves 25 and 26 are returned to the positions shown in FIG. 2. Consequently, the liquid chambers 10 and 11 are connected to the tank R allowing the piston 9 as well as the spool of the direction switching control valve 2 to return to neutral position under the influence of the return springs 3 and 4. When the piston 9 of the hydraulic actuator 8 is to be moved rightwardly, the electromagnetic coils 27 and 28 are energized and the operation proceeds in a manner similar to that described above.

Figure 3:
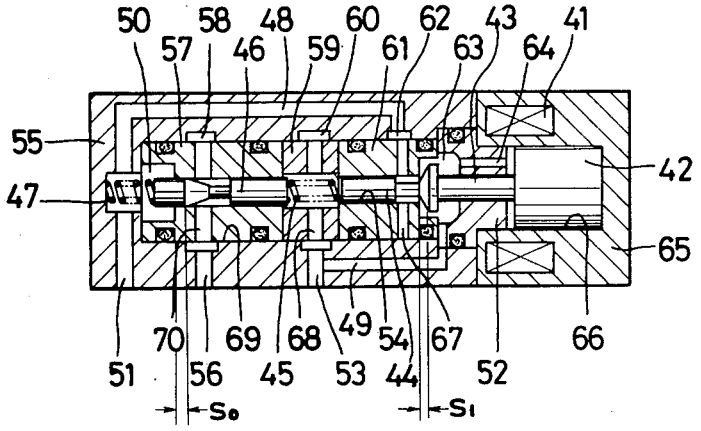
FIG. 3 is a schematic longitudinal sectional view of a unitary valve device in accordance with the present invention.

FIG. 3 shows a valve device in which a pair of valves 23 and 24 or valves 25 and 26 above mentioned are formed integrally. As shown, a cylindrical cavity 69 is defined by a casing 55 having axially spaced annular grooves 58, 60, 62. Valve housings 57, 59, 61 and 52 are longitudinally fitted in the cavity 69, the valve housing 52 having one end extended from the casing 55. Another casing 65 is fitted on an extension of the housing 52 and connects to the casing 55. The casing 65 has an electromagnetic coil 41 embedded therein and defines a cylindrical portion 66 that receives a plunger 52 responsive to the electromagnetic coil 41.

A cylindrical opening 54 extends through the centers of the respective valve housings 57, 59, 61 and 52. This cylindrical opening 54 is in communication with the annular groove 58 through a radially extending passage 70, with the annular groove 60 through a passage 68, and with the annular groove 62 through a passage 67.

The cylindrical opening 54 slidably receives a valve spool 46 in the valve housing 57, a valve spool 44 in the valve housing 61, and a rod 43 in the valve housing 52. A spring 47 is interposed between the valve 46 and an end wall of the casing 55, and a spring 45 is interposed between the valves 46 and 44. Retaining the spring 47 is a liquid chamber 50 in communication with one of the chambers of the hydraulic actuator (not shown) via an output passage 51 and also in communication with an annular groove 62 through a passage 48. The annular groove 58 is in communication with a hydraulic power source through a liquid supply passage 56. Further, the annular groove 60 is in communication with a liquid tank (not shown) through a liquid return passage 53 and also in communication with a chamber 63 between the valve housing 61 and the valve housing 52 through a passage 49. An axial passage 64 connects the chamber 63 with a cylindrical recess 66 that loosely receives the plunger 42.

The valve spool 46 defines in its central portion a tapered groove that provides variable open to closed communication between the liquid chamber 50 and the passage 70. Defined by the valve spool 44 is a tapered groove that constitutes a poppet valve to open and close between the passage 67 and the liquid chamber 63. The right end of the spool 44 is in abutment with the rod 43 of the plunger 42 so as to be forcibly moved thereby. It will be noted that each of the valve housings 57, 59, 61 and 52 has a seal ring disposed in an outer periphery thereof and is fittably received by the cylindrical cavity 69 in the casing 55.

With the electromagnetic coil 41 de-energized, the plunger 42 is held at the right-most position by the springs 47 and 45, and the valve 44 connects the passage 67 to the chamber 63 as shown in FIG. 3. Thus, the output passage 51, associated with the hydraulic actuator (not shown) is in communication with the liquid return passage 53 via the chamber 50, the passage 48, the groove 62, the passage 67, the chamber 63, and the passage 49 but is closed off from the liquid feed passage 56. When the electromagnetic coil 41 is energized, the plunger 42 and the valves 44 and 46 are forced leftward compressing the springs 45 and 47.

Let $K_1$, $K_2$, $[K_1 = a \cdot k_2\ (a > 1)]$ represent the spring constants of the springs 45 and 47; fko the set load of the springs 45 and 47, and the $s_1$ the maximum stroke of the plunger 42. If the electromagnetic force f acting on the plunger 42 is $$f \geqq k \cdot s_1, \quad f \geqq \frac{a}{a+1} k_2 \cdot s_1$$

$$\because \frac{1}{k} = \frac{1}{k_1} + \frac{1}{k_2} = \frac{1}{a \cdot k_2} + \frac{1}{k_2};$$

then, the valve 44 is moved leftward through stroke $s_1$ from the position shown in FIG. 3, the passage 67 and chamber 63 are closed from each other and the valve 46 is moved leftward through stroke $$s_2 = \frac{a}{a+1} s_1$$

If the stroke $s_o$ required of the valve 46 to produce communication between the passage 70 and the chamber 50 is predetermined as $s_2$ $s_o$, energization of the electromagnetic coil 41 causes the valve 46 to connect the passage 70 to the chamber 50, and to connect the passage 56 to the output passage 51.

As the pressure in the output passage 51 increases, the valve 46, which constitutes a pressure-reducing valve, receives liquid pressure of the chamber 50 to move the valve 46 rightward against the spring 45. This closes the liquid feed passage 56 from the output passage 51. With $s_3$ representing the deflection of the spring 45, the force $fs_3$ of the spring 45 acting on the valve 44 is given by $$fs_3 = \left( \frac{s_1}{a+1} + s_3 \right) k_1$$

and if $fs_3 \leqq f$, the output passage 51 remains closed from the liquid feed passage 56.

Since there is leakage from the liquid feed passage 56 to the output passage 51, pressure in the output passage 51 gradually increases and accordingly, the valve 46 moves rightward. This results in an increase in the deflection $s_3$ of the spring 45 until $fs_3 > f$, and as a consequence, the valve 44 is urged rightward to connect the passage 67 to the chamber 63 and the output passage 51 is brought into communication with the liquid return passage 53. This decreases the pressure in the output passage 51 and reduces the force urging the valve 44 rightward. Accordingly, the relationship $fs_3 < f$ is established, returning the valve 44 to its initial energized state.

When the electromagnetic coil 41 is energized, the operation of the valves 46 and 44 as described above is repeatedly accomplished, and the average pressure by time of the output passage 51 is determined by the energizing force of the electromagnetic coil 41. If that energizing force is varied by either the voltage or current applied to the electromagnetic coil 41, the liquid pressure of the output passage 51 can be controlled in proportion to such variations.

Figure 4:
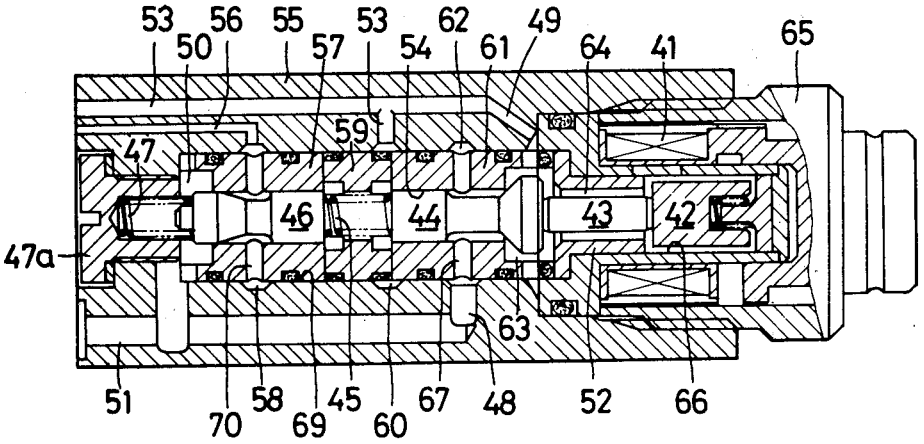
FIG. 4 is a detailed section of the valve shown in FIG. 3.

FIG. 4 shows a more specific structure of an electromagnetic valve in accordance with the present invention. Portions identical to those of the embodiment of FIG. 3 bear the same reference numerals. In this embodiment, the set load of the spring 47 is adjusted by a bolt 47*a* threadably engaging an end wall of the casing 55.

The present invention offers the following advantages over the conventional device shown in FIG. 1:

(a) The hydraulic actuator can be modified to include rods on opposite ends of its piston;

(b) Variations in tank pressure will not move the piston of the hydraulic actuator;

(c) No special electric control circuit is required for detecting the piston displacement of the hydraulic actuator as a feedback to the remote control system;

(d) With the electromagnetic open or closed valve and electromagnetic pressure-reducing valve incorporated into a single valve housing and operated by a single electromagnetic coil, the hydraulic piping structure and the structure of the remote control system can be simplified.

Obviously, many modifications and variations of the present invention are possible in light of the above teachings. It is to be understood, therefore, that the invention can be practiced otherwise than as specifically described.

What is claimed is:

1. A proportional control type remote-control direction switching control valve device comprising:

a first valve disposed between a liquid feed passage and an output passage to be opened and closed;

a second valve disposed between said output passage and a liquid returning passage to be opened and closed;

a first spring in abutment with said first valve to urge said valve toward a closed position;

a second spring interposed between said first valve and said second valve, said second spring having a biasing force greater than that of said first spring; and an electromagnetic means in abutment with said second valve and energizable to move said second valve in a closing direction and to move said first valve in an opening direction, and wherein said first and second valves and said first and second springs are disposed in a linear array and said first valve is subjected to the pressure of said output passage so as to be moved thereby in a closing direction.

* * * * *